US007237361B2

(12) United States Patent
Zwimpfer

(10) Patent No.: US 7,237,361 B2
(45) Date of Patent: Jul. 3, 2007

(54) DWELLING HOUSE WITH GRADUATED FLATS

(76) Inventor: Hans Zwimpfer, Wettsteinallee 64, CH-4058, Basel (CH)

( * ) Notice: Subject to any disclaimer, the term of this patent is extended or adjusted under 35 U.S.C. 154(b) by 538 days.

(21) Appl. No.: 10/786,836

(22) Filed: Feb. 25, 2004

(65) Prior Publication Data

US 2004/0221519 A1 Nov. 11, 2004

(30) Foreign Application Priority Data

Mar. 3, 2003 (CH) ..... 0324/03

(51) Int. Cl.
*E04H 1/00* (2006.01)

(52) U.S. Cl. ..... 52/79.1; 52/236.3

(58) Field of Classification Search ..... 52/79.2, 52/236.3, 236.4

See application file for complete search history.

(56) References Cited

U.S. PATENT DOCUMENTS 3,750,354 A * 8/1973 Boros ..... 52/236.4
3,755,974 A * 9/1973 Berman ..... 52/73
3,852,924 A * 12/1974 Levenson ..... 52/79.2
4,288,950 A 9/1981 Agassi et al.
6,826,879 B1 * 12/2004 Allen et al. ..... 52/236.3
6,922,960 B2 * 8/2005 Sataka ..... 52/236.3

* cited by examiner

*Primary Examiner*—Carl Friedman
*Assistant Examiner*—Jessica Laux
(74) *Attorney, Agent, or Firm*—Tarolli, Sundheim, Covell & Tummino LLP

(57) ABSTRACT

The invention presents the concept of a residential building which is constructed on the principle of staggered dwellings. The staggered dwellings each have a single-storey dwelling part (10, 23) and a two-storey dwelling part (11) with outdoor area. The living area (10 and 11) of the dwelling is open and allows individual living requirements to be realized with a variability which has not been known up until now. The division of space is not fixed by the static system. The type of accommodation presented can be realized in all types of urban construction such as blocks of flats, block-edge developments or high-rise buildings from two storeys upwards. The sizes of dwellings may be determined in accordance with the location and the target group. Combining the accommodation with service-related and commercial use is made possible in a completely new way using this principle.

9 Claims, 10 Drawing Sheets

11
1
10
F
100
110
F
110'
11''
11'
1''
11'
1'
11
10'
10''

DWELLING HOUSE WITH GRADUATED FLATS

FIELD OF THE INVENTION

The present invention relates to a residential building with staggered dwellings according to the preamble of Patent Claim 1.

BACKGROUND OF THE INVENTION

Many people dream of having their own house or flat. The accommodation available for the middle classes is made up of houses that are at a relatively large distance from urban agglomeration, of terraced housing closer to urban agglomeration or of rented and bought flats in the town or city or in suburbs. Flats which are available today in town and city centres are not only expensive but also, in many cases, are not attractive to those who are not keen on typically urban buildings.

Living space had to be created quickly in the years following the Second World War. In today's terms, bland residential buildings with dwellings were constructed. Architecture which was popular at the end of the nineteenth century and at the beginning of the twentieth century, and in which the facade of a house reflected the use of the latter, was lost. The facades were featureless and uniform. The facade was the same from the ground floor to the top floor and, if this is possible, the blandness was even emphasized by a flat roof. Even if the uniformity was combated at a later date with specific facade designs, a block with dwellings can only be rendered interesting to the observer by additional outlay and associated extra costs.

Maisonettes do indeed provide living-space alternatives, but do little to influence the facade design. Residential buildings with flats or maisonettes make good use of the urban areas available. The living quality, however, automatically suffers if construction is dominated by bland and monotonous blocks of flats.

SUMMARY OF THE INVENTION

It is the aim with all known types of accommodation such as "maisonettes", "split-level dwellings" or Corbusier's "Unité d'habitation" to increase the amount of space available. In these types of dwelling, however, the various storeys are always rendered accessible via internal staircases. This restricts the opportunity for adaptation to individual living-style requirements.

Since individualism and affluence permit it, it is also the case nowadays that people seek to realize their personal individuality in their living space. This results in the population moving to the suburbs or even to the country, where freely designable living space is still available and affordable. This inevitably results in the countryside being overdeveloped, with less dense building on the space available. The overdevelopment of the countryside also leads to the countryside becoming "clogged up". The traffic infrastructures for private vehicles likewise have to be constantly expanded.

It is frequently the case that very poor use is made of living space in old buildings or old factories in towns and cities. In towns and cities, for example, disused factories, warehouses and workshops are converted into living areas. This conversion preserves the structural substance of the available buildings, but does not make optimum use of the land available. Many people have become aware of such possibilities in recent years. On account of poor use being made of the space, however, the need can only be satisfied for an affluent minority of the population. In order to provide the necessary living space to meet these requirements, the relatively large areas of the former industrial spaces are divided up and converted into dwellings. The interesting and attractive feature of this living space is provided by the large rooms and the high ceilings, which let in a large amount of light and give a good sense of space. It is not uncommon for these, in "normal conditions", to be from 3.5 m to 4 m for print shops and workshops and from 4 m to 6 m for former factories.

For dwellings and residential buildings which are to be newly constructed, for financial reasons, there is no question of building dwellings with such ceiling heights. Other possibilities are therefore sought, and found, albeit with the disadvantage that most models are two-storey living areas, two single-storey living areas being rendered accessible by staircases in the region of the living areas. Many of the known types of accommodation do not give the feeling of freedom and the possibilities for the individual utilization of an open system allowing flexible design of space.

Industrial buildings, with their need for a large continuous surface area, have always been constructed with an outer shell and a roof, the roof being borne by supports. The supports interrupt the useful floor space at certain points. It is possible, in principle, for the surface area available to be divided up, in an absolutely flexible manner, by easily removable partition walls or to be utilized as a whole.

The demographic make-up of the population is characterized by increasing numbers of elderly people. Households can be divided up into a third for those living on their own, a further third for couples and a third for families or house shares with three or more people. At the same time, in Central Europe, the amount of living area required over the last 50 years has increased by 1 $m^2$ per person every two years. Older generations avoid old people's homes and usually only move after having reached the age of 80, and even then usually for medical reasons, often into care homes.

The need which arises from this is an alternative, denser type of construction in urban areas with a large amount of individual design freedom. The residents' need for their own private space should not be forgotten.

The new Röntgenareal building, by Isa Stürm and Urs Wolf, by Zurich's main railway station is an example of an attempt to provide attractive residential buildings with dwellings with single-storey living areas. Nine seven-storey residential buildings have been set up on an area at the edge of the track of Zurich's station which, until developed, was used as a storage area. The individual buildings are offset in relation to one another. The space between them is affected by the noise of the railway. The dwellings occupy the four corners and are thus directed towards two sides.

The ground floor of these urban residential buildings is occupied by dwellings and front gardens. The status of the free space is thus ambiguous. On the one hand, it belongs to everybody, and is therefore public, and on the other hand it also belongs to the tenants of these ground-floor dwellings. This combination of functions reduces the value of the areas between the residential buildings which are intended for the public. The tenants of the ground-floor dwellings try to achieve a bit of private space with hedges and small walls. The same goes on the balconies. The direct view in means that the tenants are always on public view as they go about living in the dwellings and moving on the balconies and in front of the ground-floor flats.

The uniformity of the facades and of the dwellings, the constant lack of total privacy and the associated lack of clear expression restricts the living quality in such urban residential buildings, even though public space will be provided. There is an absence of individual design possibilities and of availability of a variety of different living spaces in the same residential building, which could be achieved with a corresponding type of accommodation. The same applies to the outdoor area (terrace). It is only when the latter affords a certain amount of protection from prying eyes and is noise-proofed that the outdoor area can be defined as "private" and utilized and, in particular, regarded as such by the residents.

The object of the present invention, then, is to use an open system to provide a living area of the type mentioned in the introduction such that, in each unit, a two-storey dwelling part and outdoor area (terrace) are available, a relatively large amount of space is available specifically in the third dimension (room height), the advantages of dense construction are maintained and it is possible to realize variations in all sizes of living space, levels of comfort and the individual design of dwellings.

This object is achieved by a residential building with staggered dwellings having the features of Patent Claim 1. Further features according to the invention can be gathered from the dependent claims, and the advantages thereof are explained in the following description.

Figure 1:
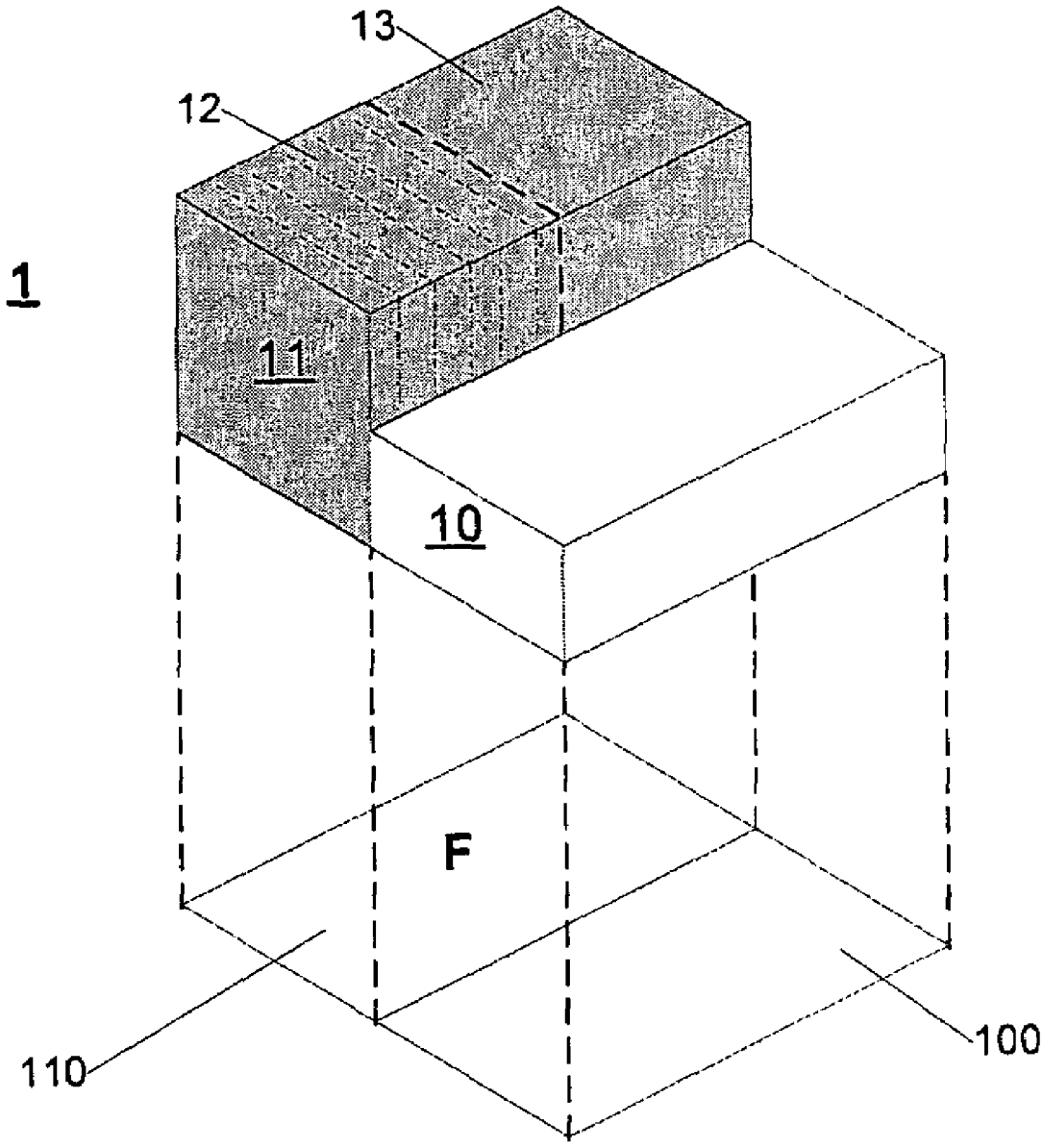
FIG. 1 shows a dwelling with an illustration of the surface areas.

The figures illustrate preferred exemplary embodiments which will be explained by way of the following description.

DETAILED DESCRIPTION OF THE INVENTION

In the residential building with staggered dwellings on which the invention is based, each dwelling 1 has a two-storey dwelling part 11 and a single-storey dwelling part 10. The way in which the surface area 100 of the single-storey dwelling part 10 is divided up may be largely adapted to requirements. The two-storey dwelling part 11 is divided up and has a two-storey living area 13 and a two-storey outdoor area 12. Each dwelling 1 thus gains extra space in comparison with conventional residential buildings.

The two high, two-storey areas, the living area 13 and outdoor area 12, are located one beside the other or one behind the other and thus allow extensive plan development.

Figure 5:
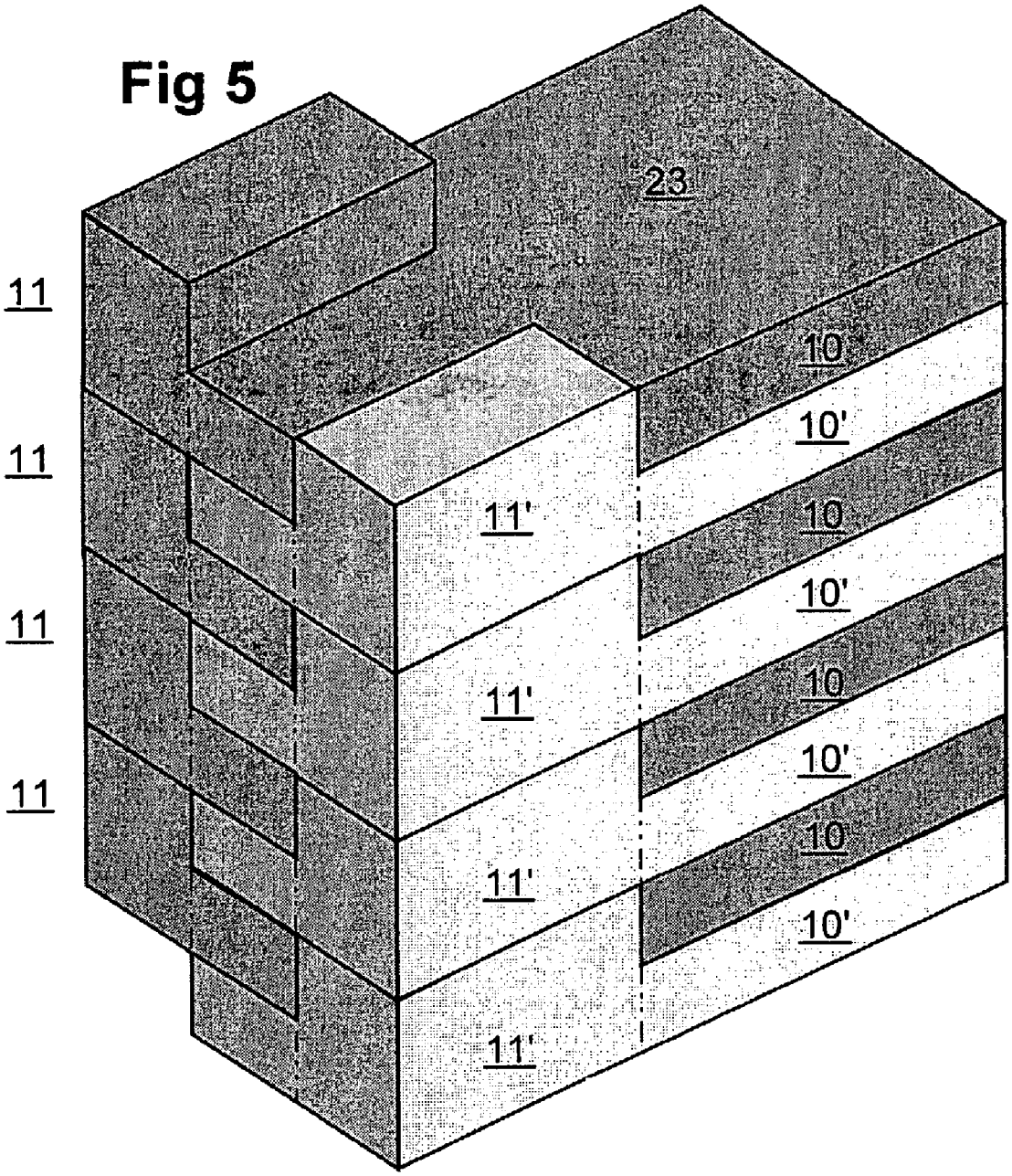
FIG. 5 shows a residential building with staggered dwellings.
Figure 6:
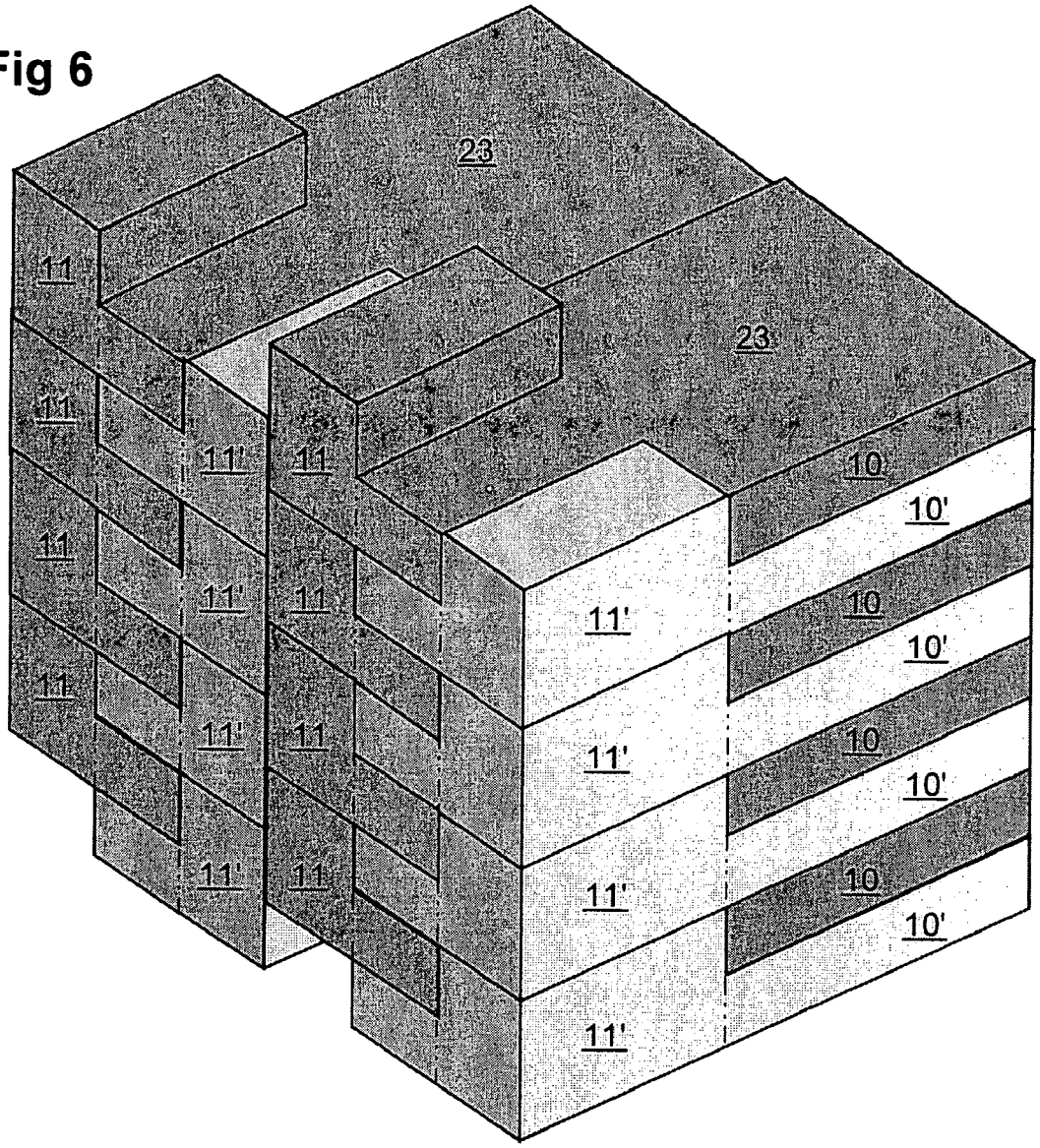
FIG. 6 shows a residential building with staggered dwellings.
Figure 7:
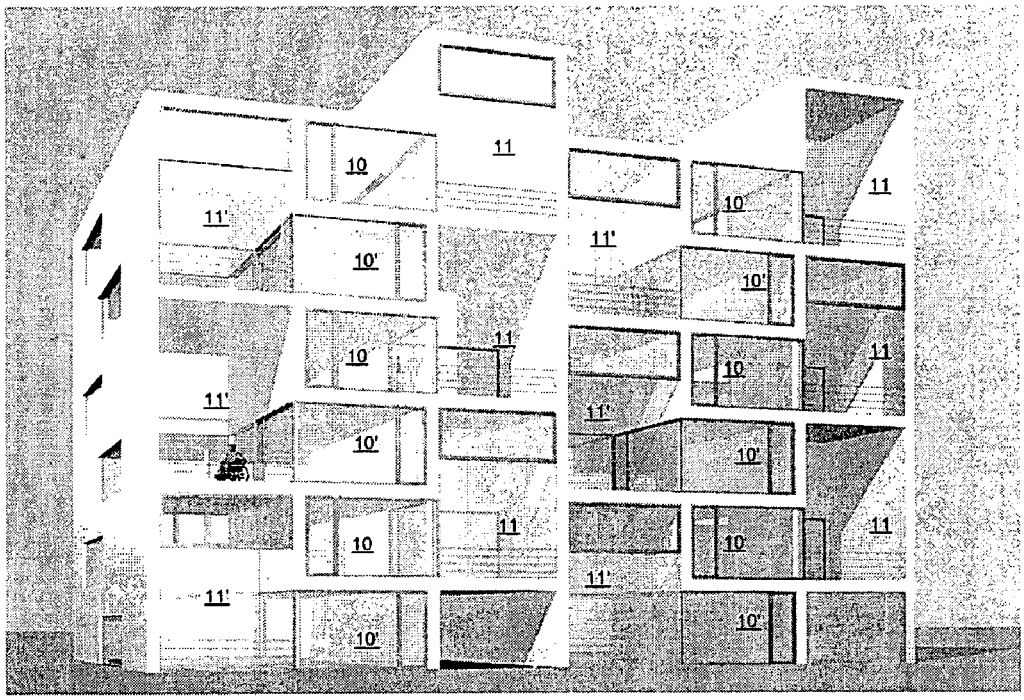
FIG. 7 a facade of a residential building with staggered dwellings.

The incidence of light into the inner zones allows a variety of different uses in the generously dimensioned single-storey dwelling part 10. By virtue of the outer appearance of the residential building which arises from the play between the single-storey dwelling part 10 and the two-storey dwelling part 11, an absolutely new sense of individuality, namely the individuality of the residential building with staggered dwellings (FIGS. 5 and 6), is expressed in the facade. This individuality is system-specific and is not dependent on expensive facade designs.

A dwelling 1, which forms the basis of the system of a residential building with staggered dwellings, is shown in FIG. 1. The dwelling 1 in FIG. 1, illustrated as a standard module, comprises two dwelling parts, a single-storey dwelling part 10 and a two-storey dwelling part 11. The surface area 100 of the single-storey dwelling part 10 is at least equal to, but usually greater than, the surface area 110, indicated by F, of the two-storey dwelling part 11. The two-storey dwelling part 11 is approximately double the height of the single-storey dwelling part 10 and is divided up into an outdoor area 12 and an indoor area 13. The outdoor area 12 is always directed towards a facade side of the residential building. The surface area of the single-storey dwelling part 10 will be greater, for practical reasons, than that of the two-storey dwelling part 11. However, all the single-storey dwelling parts 10 on one level of a residential building with staggered dwellings will have the same total surface area 100. The way in which the region of the single-storey dwelling parts 10 is divided up can be freely selected and can thus be adapted, with a high level of flexibility, to the respective requirements.

If the plans are based, for example, on two 4-room dwellings, it is possible, with most types, for at least one room to be optionally assigned to the neighbouring dwelling. The accommodation available is thus made up of three-room, four-room and 5-room dwellings. Like the size of dwelling, it is also possible for the standard of comfort to be adapted to the specific requirements in each case. Examples of this are as follows: direct lift access into the dwellings, increasing the size of the outdoor area 12 to the detriment of the two-storey living area 13, the availability of a cooling system, the installation of a fireplace and chimney etc., the open construction system in the basic state allows individual completion work by the tenant. The way in which rooms are divided up, the type of kitchen and sanitary zones, and the design of floors, walls, ceilings and installations may thus be freely selected.

The surface area of the two-storey dwelling part 11 is the same for all dwellings 1 in a residential building with staggered dwellings. Different residential buildings with staggered dwellings, however, may have two-storey dwelling parts 11 with different surface areas 110. The two-storey dwelling parts 11 always rise above a level. They are arranged alternately, which is evident from the drawings.

Figure 2:
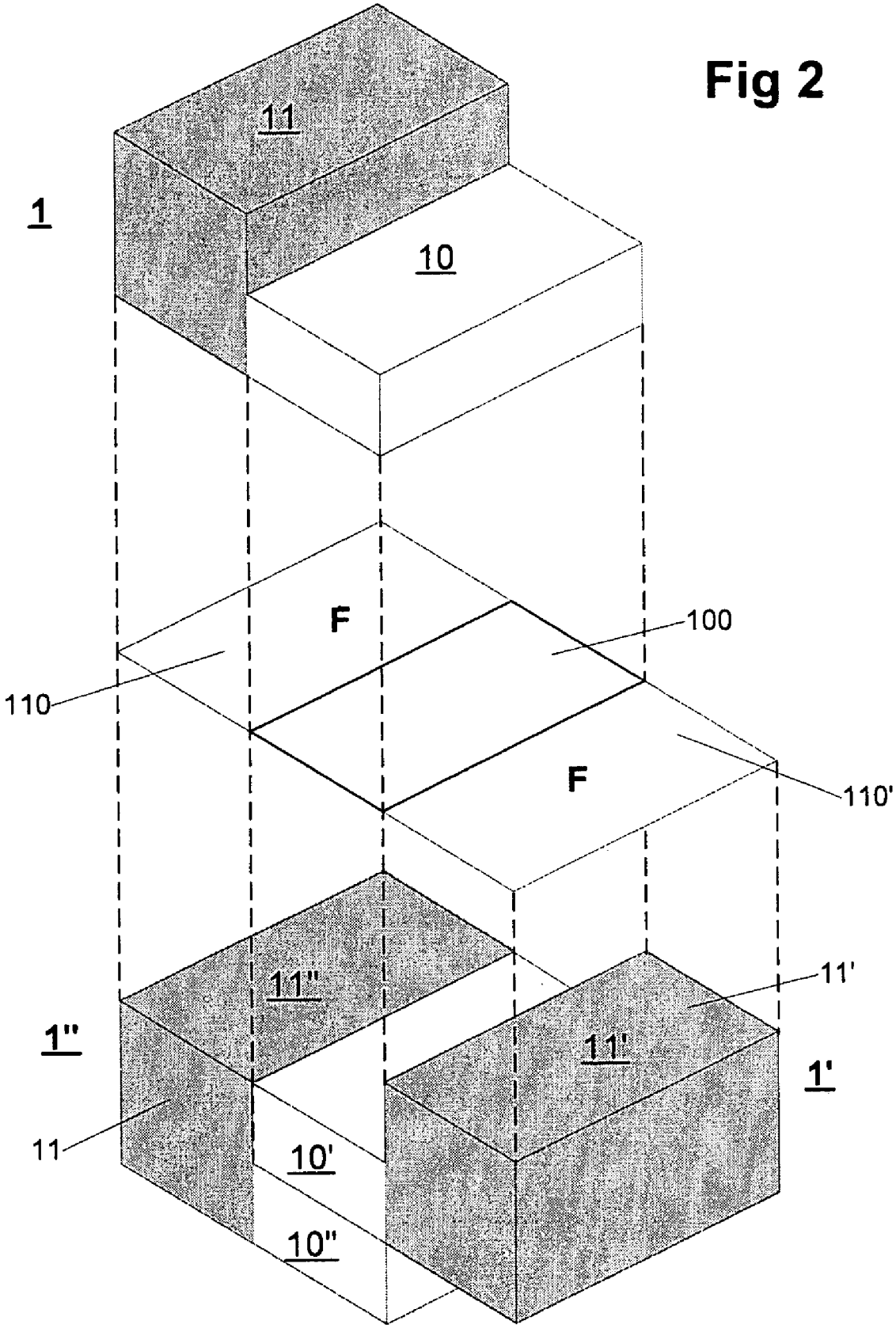
FIG. 2 shows two dwellings with the single-storey living areas overlapping.
Figure 3:
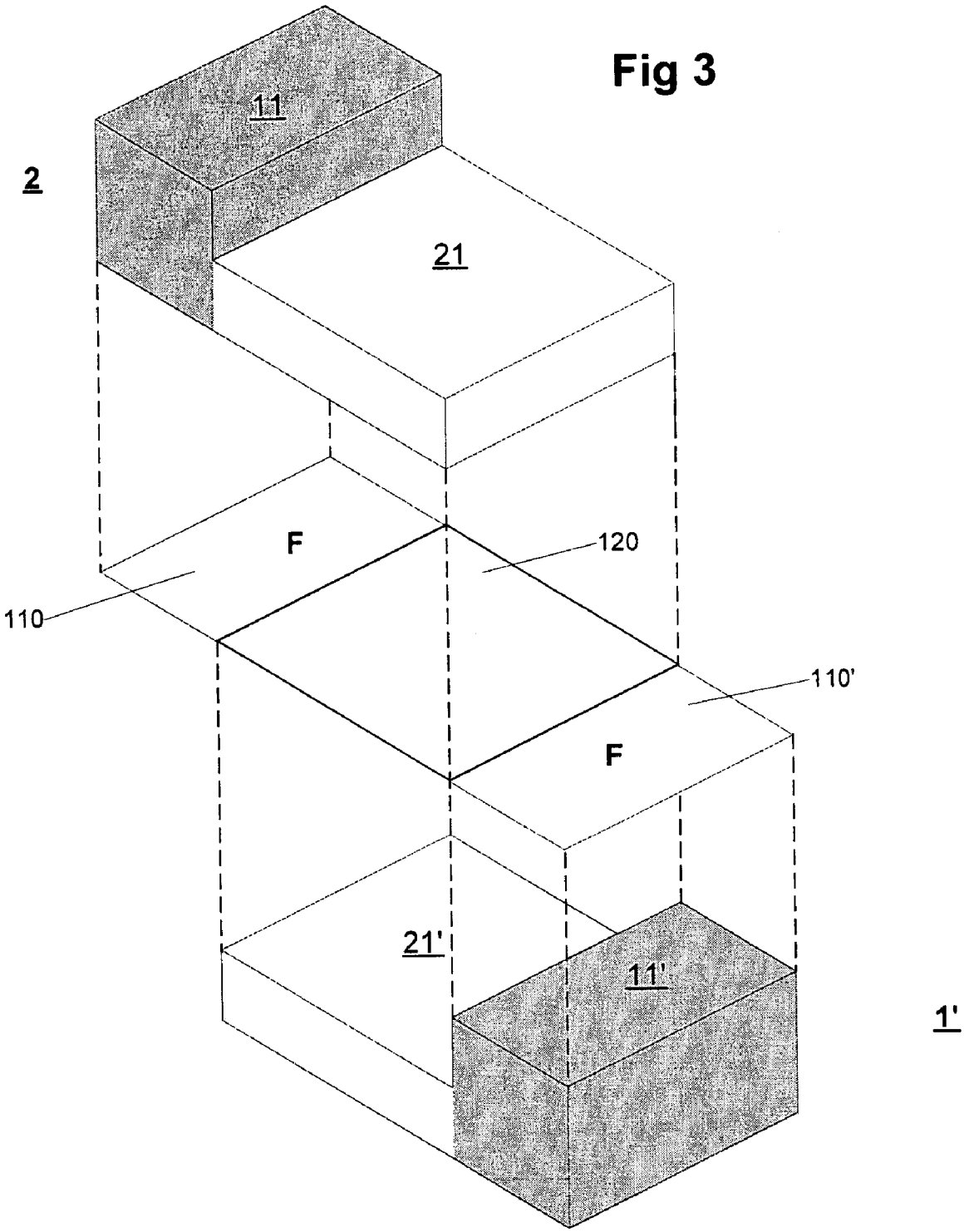
FIG. 3 shows two dwellings with the single-storey living areas overlapping.
Figure 4:
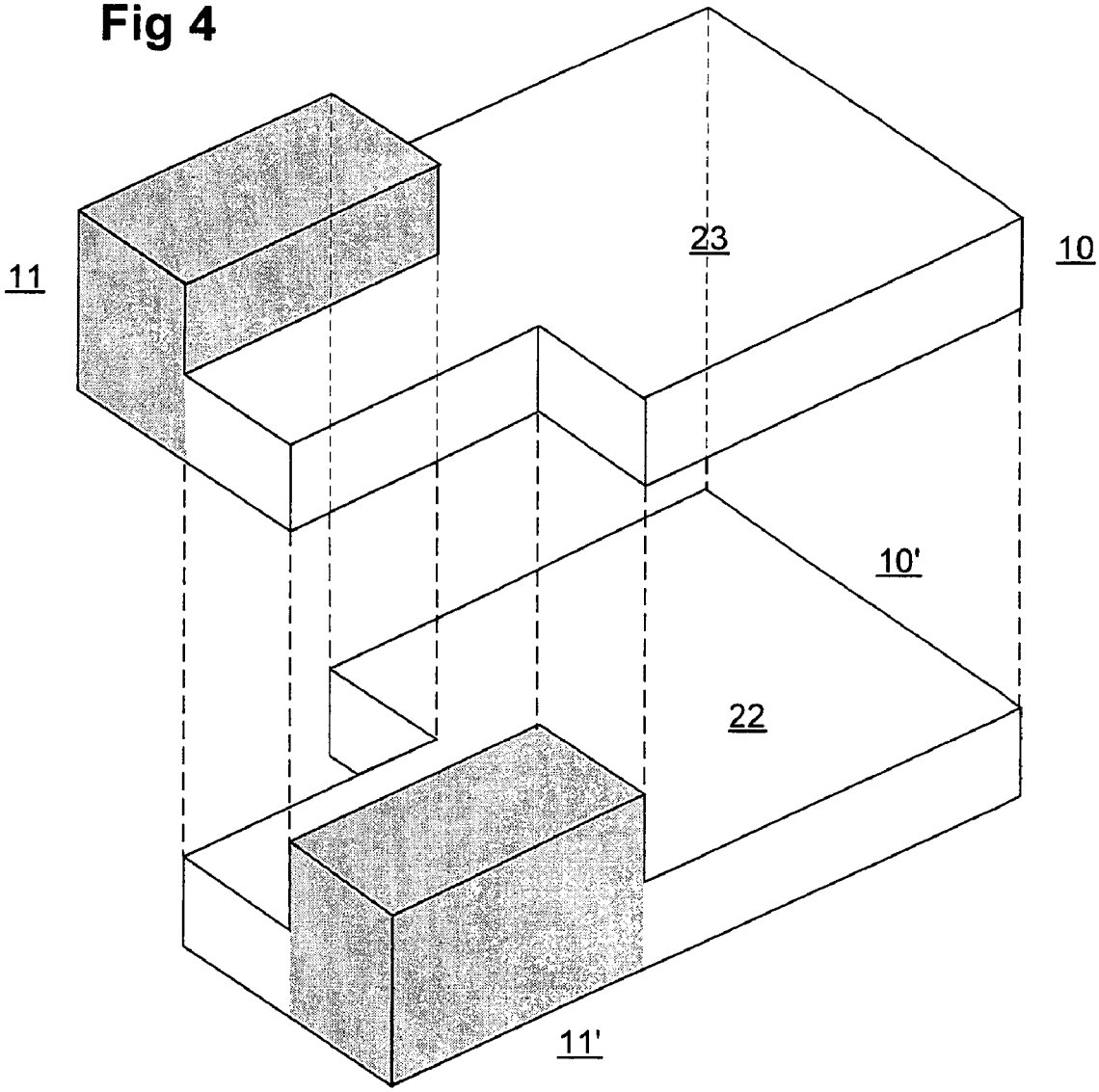
FIG. 4 shows two dwellings with a large single-storey living area.

FIG. 2 shows how, in the case of the construction system according to the invention, a second dwelling 1' with a single-storey dwelling part 10' and a two-storey dwelling 11' ends up located over the surface area 110/100/110', with a offset in relation to the dwelling 1. Both dwellings 1 and 1' are located over the surface area 100. While the lower dwelling 1' rests on the surface areas 100 and 110', the dwelling 1 has the surface area 100 located above the dwelling 1'. Beneath the two-storey dwelling part 11, the surface area 110 is free by the height of the single-storey dwelling part 10'. The size of the single-storey dwelling part 10' may be increased such that it fills the surface area 110 beneath the two-storey dwelling part 11. In the lowermost-storey, this area may also be utilized as a storage or service area. Examples of how the surface area of the single-storey dwelling part 10 can be extended are shown in FIGS. 3 and 4.

Residential buildings with staggered dwellings are based on a completely new urban concept. In a densely populated environment, the desire for living space goes hand in hand with the demand for commercial areas such as local shops and offices. The residents of such areas naturally want a calm and natural environment of individual design. This demand is ideally met by the system of the residential building with staggered dwellings according to the invention. Nature may be brought into the dwelling to a certain extent; indeed, the ceiling height in the two-storey dwelling part is such that it is possible to keep even relatively large plants. In respect of rail and road traffic, the concept of designing a self-contained building makes it possible to protect the living areas against noise.

Figure 9:
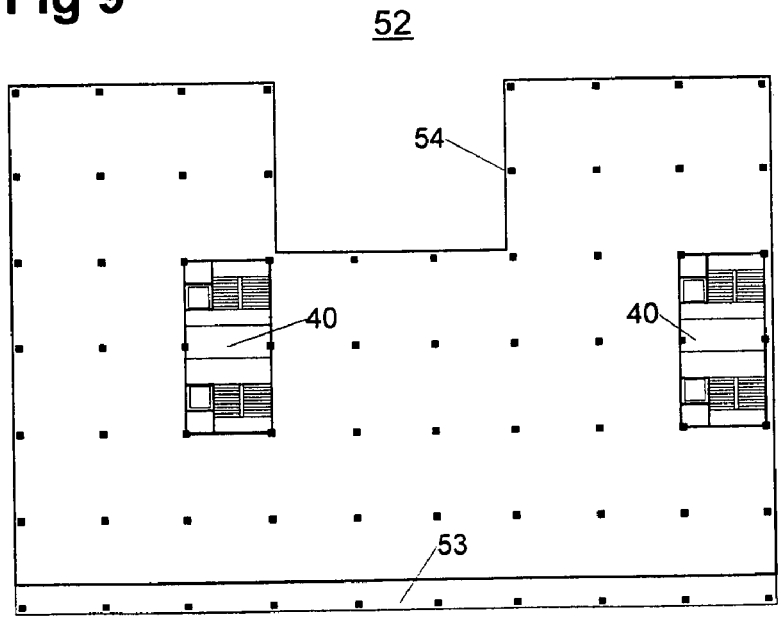
FIG. 9 shows a plan view of a ground-floor shop area.

Access to all the storeys of a building according to the invention is ensured via the staircase and lift installations 40 (FIG. 9). The drawings each depict a lift, the number of lifts and also the number of necessary staircases depending on the overall concept of the building. This type of design makes it possible to provide the upper dwellings with direct lift access without any additional outlay.

Figure 8:
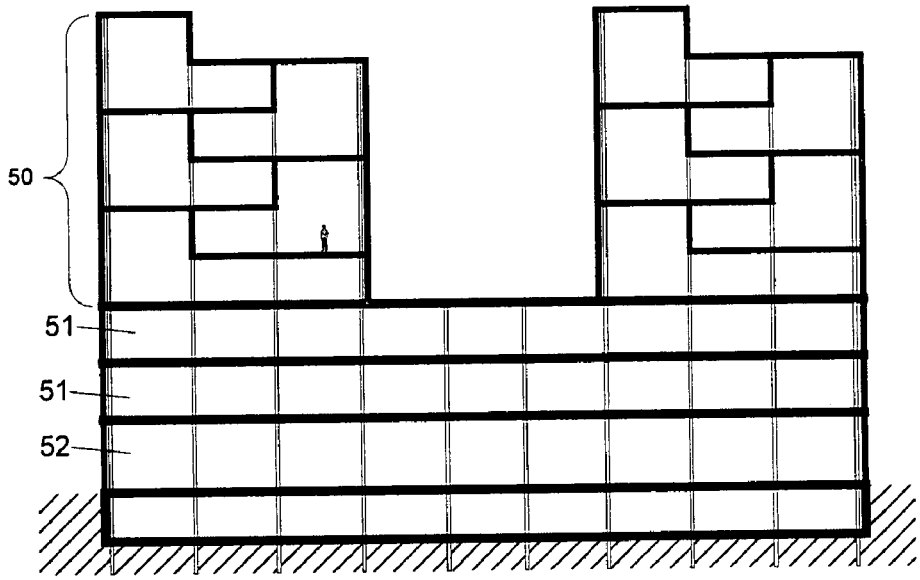
FIG. 8 shows a section through a residential building with a shop area, an office area and staggered dwellings.

FIG. 8 illustrates a cross section of a residential building with a shop area 52, an office area 51 and staggered dwellings 50. The lowermost storeys, illustrated in FIG. 8 by the ground-floor storey, are constructed with a greater ceiling height, are on one level and, as is shown in FIG. 9, extend over the entire surface area of the building. These storeys are ideally suited for use as a shop area 52. Artificial light is preferred for shop areas, with the result that the relatively poor incidence of light for a storey with a very large surface area does not matter. If the upper storeys of the building are designed with a facade recess 54, the shop area 52 in this region may be provided with natural light through skylights 55. On the ground floor, the shop area 52 may be supplemented by a covered exterior passageway 53 for the sale of promotional items, fresh vegetables or other articles which are to be made as accessible to the customer as possible.

Figure 10:
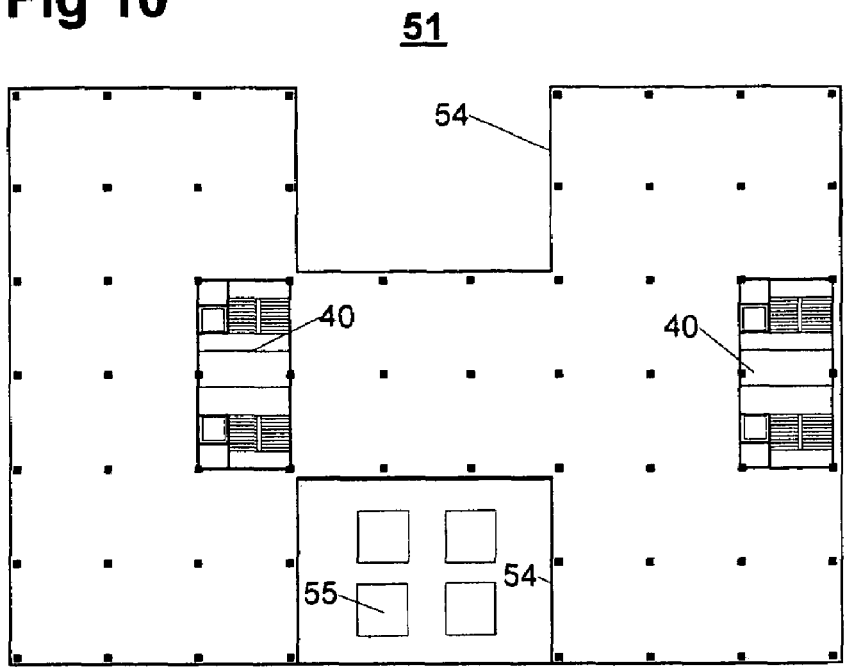
FIG. 10 shows a plan view of an office level.

The storeys directly above the shop areas 52 (FIGS. 8 and 10) are likewise on a single level with freely designable partitioning for office areas 51. The plan differs from that of the first storey in so far as the surface area of the facade is increased by the provision, for example, of a facade recess 54. This makes it possible to achieve more office area 51 with direct incidence of natural light.

Figure 11:
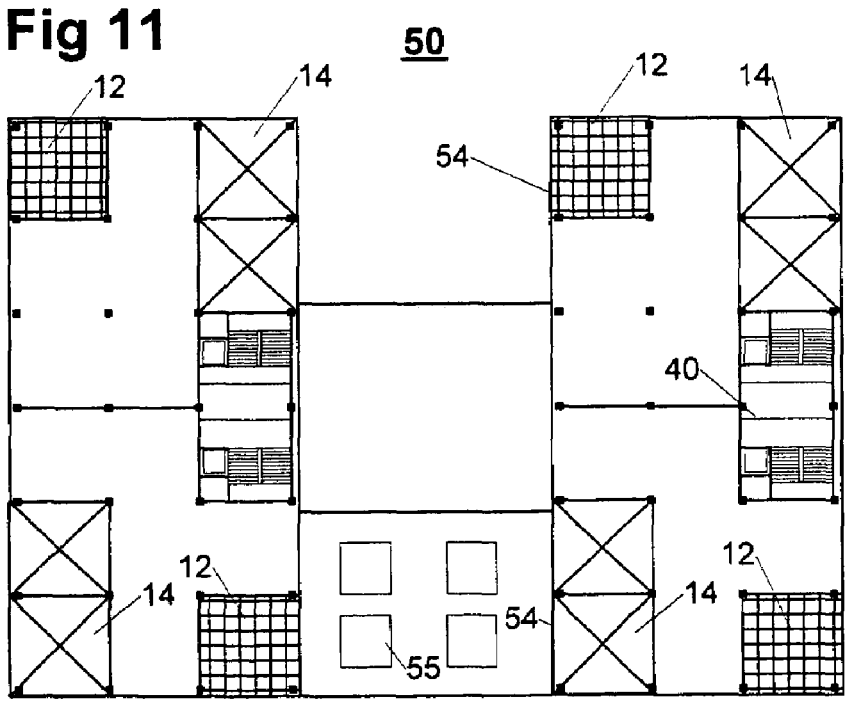
FIG. 11 shows a plan view of a storey with staggered dwellings.

Above this, use is then made of the concept and system of the residential building with staggered dwellings according to the invention (FIG. 11). It is also the case in this region that use is made of the large surface area of the facade in order to provide a lot of direct natural light. The two-storey living area 14 of the dwelling beneath projects into the storey plan 50.

In this type of concept (FIGS. 8, 9, 10 and 11), by way of example, it is possible to arrange four dwellings 1 on each storey without giving the effect of a "tower block". Each dwelling has a two-storey living area and thus an outdoor area 12. In this system, it is possible to construct "towers" with good accommodation availability which enrich the urban landscape and provide the residents with homely, interesting and individually designable living areas.

Figure 12:
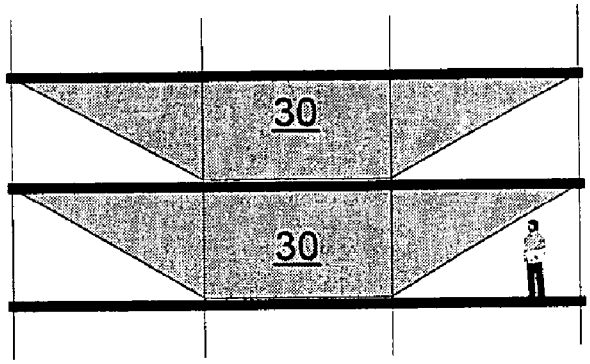
FIG. 12 shows the incidence of light in a dwelling with a single-storey living area.
Figure 13:
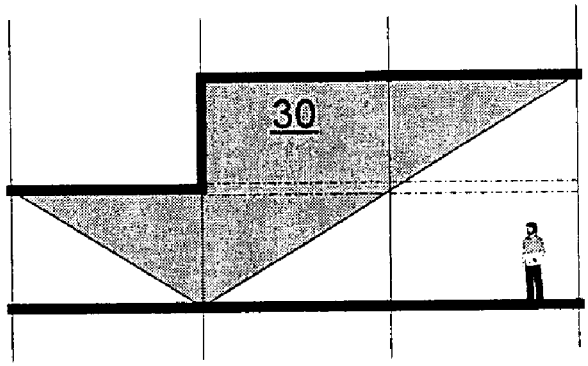
FIG. 13 shows the incidence of light in the two-storey dwelling part of a staggered dwelling.
Figure 14:
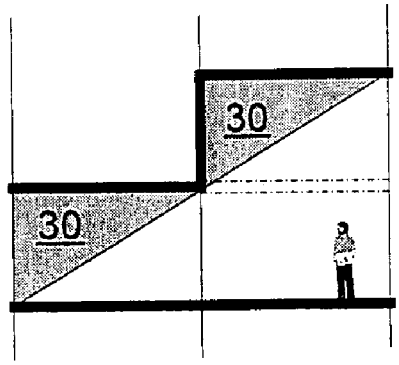
FIG. 14 shows the incidence of light in the two-storey dwelling part of a staggered dwelling.

The incidence of light is a central advantage for the concept of the staggered dwellings according to the invention. FIGS. 12, 13 and 14 illustrate in section how the system presented admits light right into the actual living space as a result of the height of the two-storey dwelling part 11. The volume 30 which is not exposed to direct light (FIGS. 12, 13 and 14) is greater. The double height of the outdoor area 12 arranged on the facade side ensures more light according to the invention.

The invention claimed is:

1. A residential building comprising a plurality of dwellings, each of said dwellings includes a single-storey dwelling part and a two-storey dwelling part, said single-storey dwelling part of a lower dwelling being disposed beneath said single-story dwelling part of an upper dwelling, said two-storey dwelling part of said lower dwelling having a floor which is on the same level as a floor of said one-storey dwelling part of said lower dwelling, said two-story dwelling part of said lower dwelling having a ceiling which is on the same level as a ceiling of said one-storey dwelling part of said upper dwelling, said two-storey dwelling part of said lower dwelling having an open space which extends from said floor of said two-story dwelling part of said lower dwelling to said ceiling of said two-storey dwelling part of said lower dwelling and is at least partially defined by a two-storey first wall which extends from the floor of said lower dwelling to the ceiling of said two-storey dwelling part of said lower dwelling and a one-storey second wall which extends from the ceiling of said one-storey dwelling part of said lower dwelling to the ceiling of the two-storey dwelling part of said lower dwelling, said one-storey second wall of said two-storey dwelling part of said lower dwelling forming at least a portion of a one-storey wall of said single-storey dwelling part of said upper dwelling, said one-storey second wall of said two-storey dwelling part of said lower dwelling separates at least a portion of said single-storey dwelling part of said upper dwelling from said two-storey dwelling part of said lower dwelling.

2. A residential building as set forth in claim 1 wherein the floor of said single-storey dwelling part of said lower dwelling has a surface area which is at least as great as a surface area of a floor said two-storey dwelling part of said lower dwelling.

3. A residential building as set forth in claim 1 wherein said two-storey dwelling part of said lower dwelling includes an indoor area and an outdoor area which opens outwardly toward a facade of the residential building.

4. A residential building as set forth in claim 1 wherein the floor of said two-storey dwelling part of said lower dwelling has the same surface area as a floor of said two-storey dwelling part of said upper dwelling.

5. A residential building as set forth in claim 4 wherein the floor of said single-storey dwelling part of said lower dwelling has the same surface area as a floor of said single-storey dwelling part of said upper dwelling.

6. A residential building as set forth in claim 1 wherein said single-storey dwelling part of said upper dwelling extends from said two-storey dwelling part of said upper dwelling to said two-storey dwelling part of said lower dwelling.

7. A residential building as set forth in claim 6 wherein said single-storey dwelling part of said upper dwelling is disposed above said single-storey dwelling part of said lower dwelling throughout the extent of said single-storey dwelling part of said upper dwelling.

8. A residential building as set forth in claim 1 further including a lower storey disposed beneath said upper and lower dwellings, said lower storey having the same ceiling height throughout the extent of said lower storey.

9. A residential building as said forth in claim 1 wherein said two-storey dwelling part of said lower dwelling includes an indoor area and an outdoor area which opens outwardly toward a facade of the residential building, said two-storey dwelling part of said upper dwelling includes an indoor area and an outdoor area which opens outwardly toward the facade of the residential building, said outdoor area of said two-storey dwelling part of said lower dwelling being horizontally offset from said outdoor area of said two-storey dwelling part of said upper dwelling.

* * * * *

UNITED STATES PATENT AND TRADEMARK OFFICE

CERTIFICATE OF CORRECTION

PATENT NO. : 7,237,361 B2
APPLICATION NO. : 10/786836
DATED : July 3, 2007
INVENTOR(S) : Hans Zwimpfer It is certified that error appears in the above-identified patent and that said Letters Patent is hereby corrected as shown below:

Column 6, line 19, after “single-” delete “story” and insert --storey--

Column 6, line 22, after “two-” delete “story” and insert --storey--

Column 6, line 27, after “two-” delete “story” and insert --storey--

Signed and Sealed this

Fourth Day of September, 2007

JON W. DUDAS
*Director of the United States Patent and Trademark Office*